US007123825B2

(12) United States Patent
Abbott

(10) Patent No.: US 7,123,825 B2
(45) Date of Patent: Oct. 17, 2006

(54) WATER HEATER AND METHOD OF PROVIDING THE SAME

(75) Inventor: Richard C. Abbott, New Boston, NH (US)

(73) Assignee: ThermoCeramix, Inc., Shirley, MA (US)

( * ) Notice: Subject to any disclaimer, the term of this patent is extended or adjusted under 35 U.S.C. 154(b) by 0 days.

(21) Appl. No.: 11/208,508

(22) Filed: Aug. 22, 2005

(65) Prior Publication Data

US 2006/0049162 A1 Mar. 9, 2006

Related U.S. Application Data

(60) Provisional application No. 60/603,431, filed on Aug. 20, 2004.

(51) Int. Cl.
*F24H 1/10* (2006.01)

(52) U.S. Cl. ..... 392/466; 219/547

(58) Field of Classification Search ..... None
See application file for complete search history.

(56) References Cited

U.S. PATENT DOCUMENTS

| | | | | |
|---|---|---|---|---|
| 3,683,361 | A * | 8/1972 | Salzwedel et al. | 338/322 |
| 4,808,490 | A * | 2/1989 | Tsukuda et al. | 428/699 |
| 5,616,263 | A * | 4/1997 | Hyllberg | 219/469 |
| 6,124,579 | A * | 9/2000 | Steinhauser et al. | 219/544 |
| 6,127,654 | A * | 10/2000 | Fletcher | 219/216 |
| 6,222,166 | B1 * | 4/2001 | Lin et al. | 219/538 |
| 6,300,607 | B1 * | 10/2001 | Steinhauser et al. | 219/544 |
| 6,376,816 | B1 * | 4/2002 | Cooper et al. | 219/543 |

* cited by examiner

*Primary Examiner*—Thor S. Campbell
(74) *Attorney, Agent, or Firm*—Peter A. Nieves, Esq.; Sheehan, Phinney, Bass & Green, P.A.

(57) ABSTRACT

An apparatus for heating fluid and a method for providing the same is provided. Generally, the system contains a metallic core; a dielectric layer thermally sprayed on the core; a resistive heater layer thermally sprayed on the dielectric layer; a metallic layer portion located at ends of the resistive heater layer; and a source of power providing said power via said metallic layer portion.

9 Claims, 5 Drawing Sheets

WATER HEATER AND METHOD OF PROVIDING THE SAME

CROSS-REFERENCE TO RELATED APPLICATION

This application claims priority to copending U.S. Provisional Application entitled, "Water Heater and Method of Providing the Same," having Ser. No. 60/603,431, filed Aug. 20, 2004 and also claims the benefit of the currently pending patent application entitled, "Resistive Heaters and Uses Thereof," having Ser. No. 09/996,183, being filed on Nov. 28, 2001, which is entirely incorporated herein by reference.

BACKGROUND OF THE INVENTION

The present invention is generally related to water heaters, and more particularly is related to thermally sprayed water heater capable transforming large amounts of power to heat without failure, and in a very efficient manner.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The present invention provides a water heater having a heating apparatus therein. Of course, the water heater may be utilized to heat other fluids. The heating apparatus may be provided within the water heater in many different configurations. In addition, the heating apparatus contains a thermally sprayed resistive heating layer, where the heating apparatus is capable of transforming large amounts of power to heat without failure, and in a very efficient manner. The heating apparatus is described in detail herein.

Figure 1:
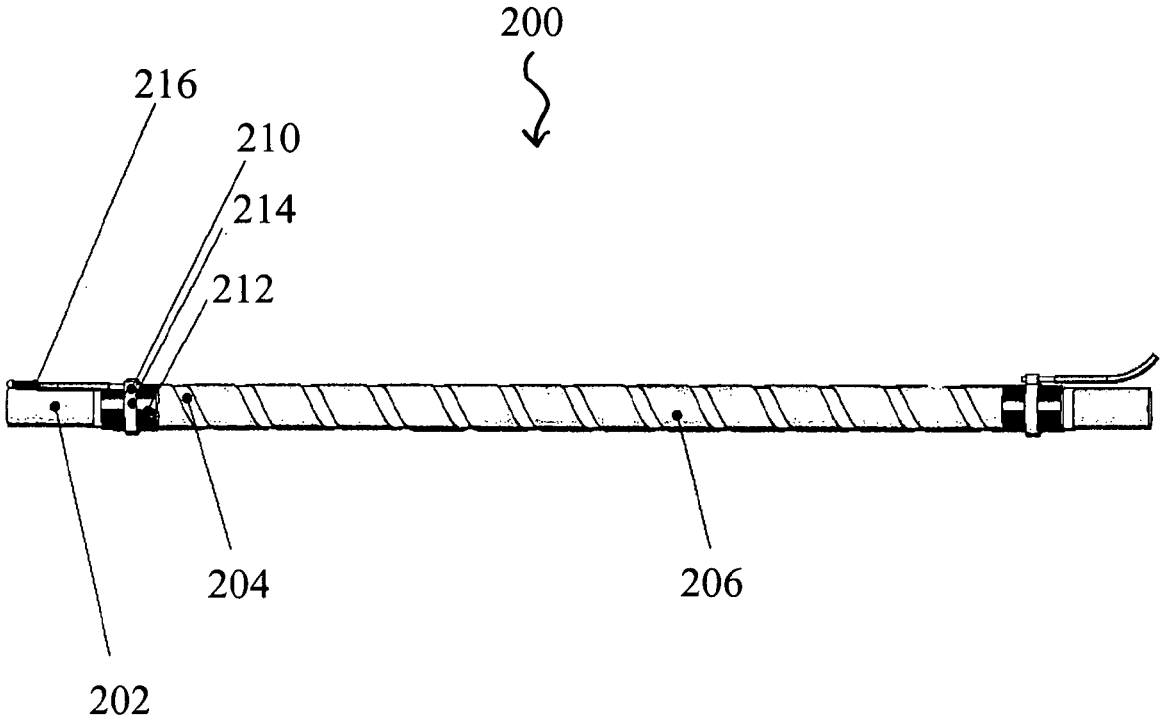
FIG. 1 is a side view of a heating apparatus that would be provided within a water heater, in accordance with a first exemplary embodiment of the invention.

FIG. 1 is a side view of a heating apparatus 200 that would be provided within the water heater, in accordance with a first exemplary embodiment of the invention. As is shown by FIG. 1, the heating apparatus 200 contains a thermally conductive central core 202. The core 202 may be made of different metals that are thermally conductive. As an example, in accordance with the first exemplary embodiment of the invention, the core 202 is made of copper. Of course, the core 202 may also be created from other thermally conductive metals, such as, but not limited to, brass, aluminum, stainless steel, carbon steel, titanium, other alloys. The core 202 may also be made of a pipe having a serrated inside surface. The core 202 preferably has a rough exterior surface, which may be provided by different methods, such as, but not limited to, grit blasting.

The heating apparatus 200 contains a dielectric layer 204 located on the core 202. The dielectric layer 204 is preferably thermally sprayed onto an exterior surface of the core 202. The dielectric layer 204 is an electrical insulator that is thermally conductive. Examples of materials that may be utilized as the dielectric layer 204 include, but are not limited to, aluminum oxide, porcelain, zirconium oxide, spinel, other ceramics, and polymers.

An example of a method that may be utilized for thermally spraying the dielectric layer onto the core is described in the co-pending patent application entitled, "Resistive Heaters and Uses Thereof," having Ser. No. 09/996,183 (hereafter, the '183 patent), being filed on Nov. 28, 2001, which is entirely incorporated herein by reference. It should be noted that the '183 patent describes methods of depositing materials capable of generating high power, where the deposited materials bond by chemical action to a different material.

The heating apparatus 200 has a sealant (not shown in figures) located on an external surface of the dielectric layer 204. Examples of sealants may include a polymer sealant such as, but not limited to, polyketone, or other polymers, glassy materials, and/or nanophase materials. Since the thermally sprayed dielectric layer 204 is partially porous, the sealant penetrates open porosity and seals the dielectric layer 204, thereby improving strength of the dielectric layer 204 in accommodating for large amounts of voltage provided to the heating apparatus 200.

A resistive heater layer 206, which has been calculated and designed to have a specific resistivity, is located on an external surface of the sealant. Specifically, the resistive heater layer 206 is thermally sprayed on the sealant, where the length, width, and thickness of the resistive heater layer 206 have been predetermined in accordance with a specific power and voltage to be administered to the heating apparatus 200. Prior to thermally spraying the resistive heater layer 206, the sealant on the dielectric layer 204 is masked so as to allow the resulting resistive heater layer 206 to have the predetermined length, width, and thickness.

It should be noted that the procedure of designing the resistive heater layer 206 to have a specific resistivity, and the process of thermally spraying the resistive heater layer 206, are described in detail in the '183 patent. As an example, the '183 patent describes a portion of the procedure, in one embodiment, as determining a desired resistivity of the resistive heater layer; selecting a metallic component and at least one reactant gas; selecting a proportion of the metallic component and the at least one reactant gas, so that when combined the desired resistivity of the resistive heater layer results; promoting reaction of the metallic component and the reactant gas, thereby combining the metallic component and the reactant gas, resulting in a free metal and reaction product; and depositing the combined free metal and reaction product on the substrate to form the resistive heater layer having the desired resistivity.

The mask is removed from the sealant on the dielectric layer 204 after thermally spraying the resistive heater layer 206, thereby resulting in the resistive heater layer 206 having the desired thermal resistivity, and length, width, and thickness. It will be understood by those having ordinary skill in the art, that many different methods of masking may be used, such as, but not limited to, using masking tape or a spring.

At least one electrical contact area 210 is located on a portion of the resistive heater layer 206. The electrical contact area 210 contains a metallic layer portion 212. As an example, the metallic layer portion 212 may be thermally sprayed onto a portion of the resistive heater layer 206. The metallic layer portion 212 may be made of copper or any other conductive material. As an example, the metallic layer portion 212 may instead comprise nickel, gold, silver, or other metals. Preferably, there is a metallic layer portion 212 on each end of the resistive heater layer 206. It should be noted that the material utilized for the metallic layer portion 212 should be capable of adhering to the material used to create the resistive heater layer 206 and be capable of having solder adhere thereto.

A solder joint 214 is provided within the electrical contact area 210 for connecting an electrical wire 216 to the metallic layer portion 212. It should be noted that it is preferable that there be low electrical resistance in the solder joint 214, thereby preventing loss of power received from a power source. In addition, since there is low electrical resistance in the solder joint 214, the electrical contact area 210 remains cool and a solder that is only capable of withstanding a low temperature may be used in the heating apparatus 200. Of course, other types of solder, being capable of withstanding much higher temperatures, may be used. To provide the solder joint 214, any known technique of melting solder to the metallic layer portion 212 may be utilized. In addition, the solder may instead connect the electrical wire 216 to the metallic layer portion 212 via thermally spraying the solder so as to connect the electrical wire 216 to the metallic layer portion 212 or any other material having similar properties to the solder.

To complete the heating apparatus 200 the electrical contact area 210 may be protected by a material. As an example, the electrical contact area 210, or ends of the heating apparatus 200, may have an epoxy tape wrapped around it. The heating apparatus 200 may then have a heat-shrink sheath wrapped around the heating apparatus 200, and the epoxy may be cured. The sheath may be a polyolefin heat shrink tube. Alternatively, the sheath may be a Teflon, viton, or other polymer heat shrink tube. In addition, the sheath may comprise glass fiber or polymer foam. It should be noted that the sheath and epoxy work together to prevent airborne water vapor from attacking the resistive heater and dielectric layers. In addition, the sheath insulates electrically and thermally, and reflects heat toward fluid being heated in the water heater.

During use of the water heater, current enters the heating apparatus 200 from a power source located either within the water heater or external to the water heater, via the electrical wire 216. The current traverses the metallic layer portion 212, and then enters the resistive heater layer 206. As the current traverses the resistive heater layer 206, the resistive heater layer 206 provides heat, thereby heating any water that is local to the heating apparatus 200.

Figure 3:
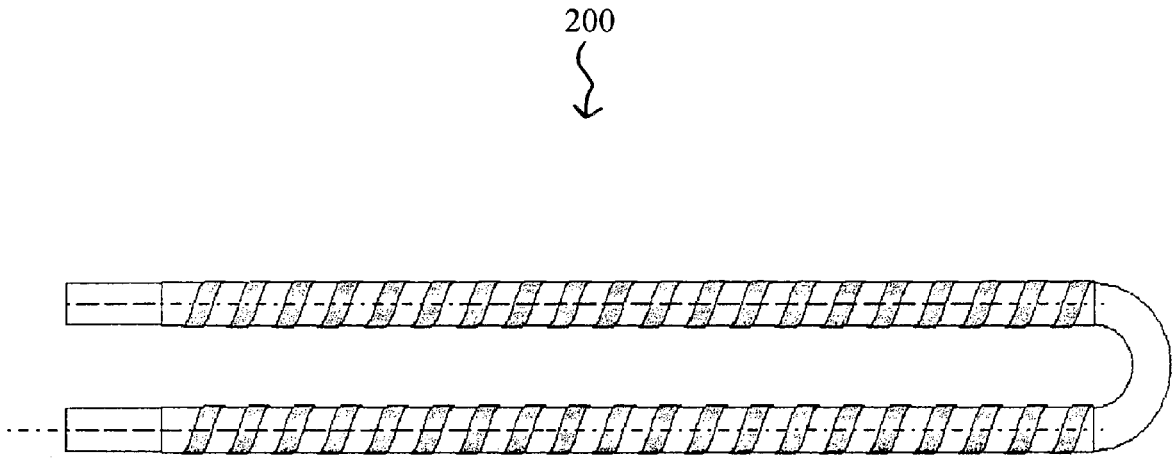
FIG. 3 is a top view of a heating apparatus having a U-shape, in accordance with a second exemplary embodiment of the invention.
Figure 4:
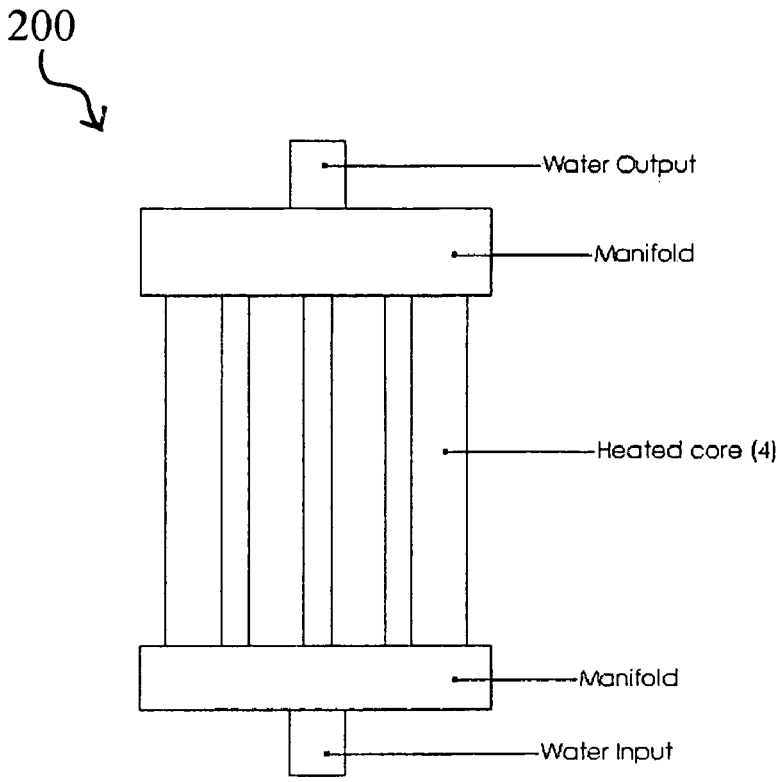
FIG. 4 is a side view of a heating apparatus having manifolded pipes, in accordance with a third exemplary embodiment of the invention.
Figure 5:
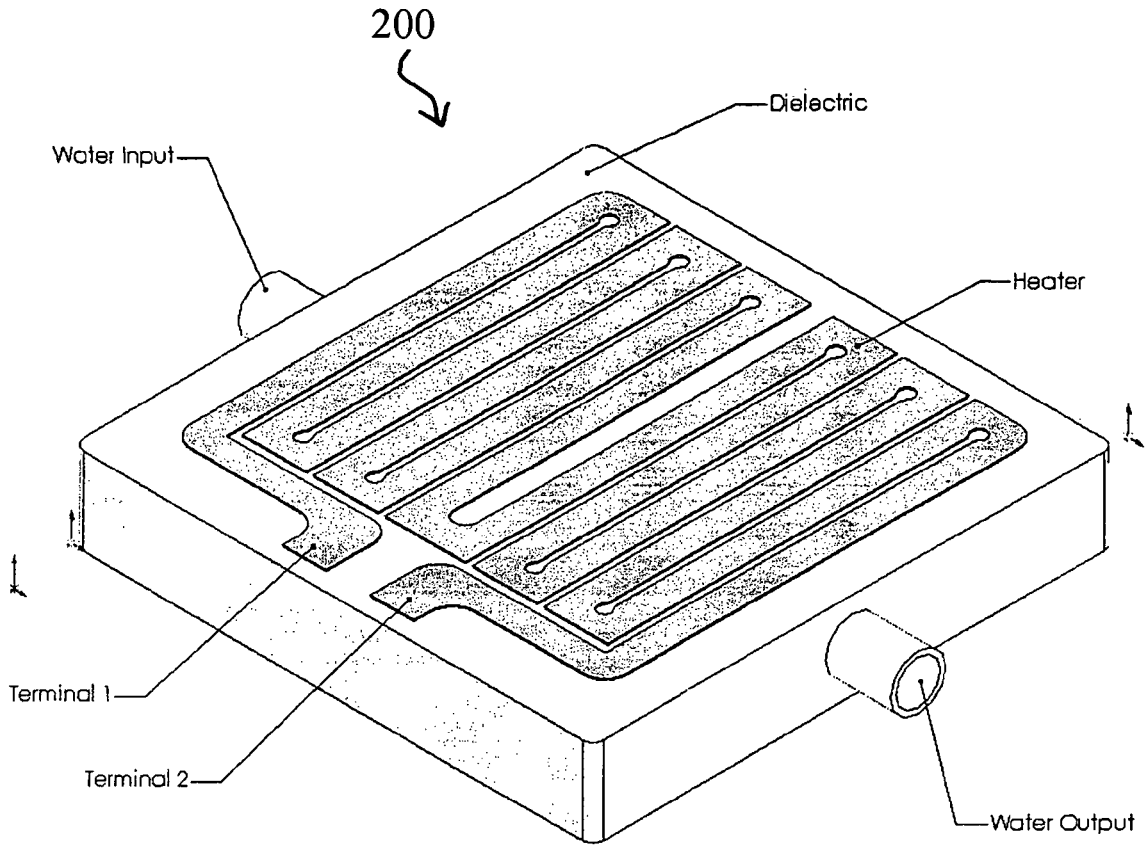
FIG. 5 is a perspective view of a heating apparatus having a cavity and flat sides, in accordance with a fourth exemplary embodiment of the invention.

It should also be noted that different shapes of the heating apparatus 200 and water heater may be provided. As an example, the heating apparatus 200 may be straight and elongated (FIG. 1) or U-shaped (FIG. 3). In addition, the heating apparatus 200 may be provided as manifolded pipes (FIG. 4) or as a cavity having flat sides (FIG. 5).

With regard to thermal spraying, it is beneficial to thermally spray both the dielectric layer 204 and the resistive heater layer 206 so as to provide high bond strength to give optimum heat transfer. In addition, the thermally conductive paths mentioned above, are preferably short, so as to reduce thermal resistance (i.e., thin dielectric layer and thin resistive heater layer). Further, the water heater, as described above, is preferably metal.

Figure 2:
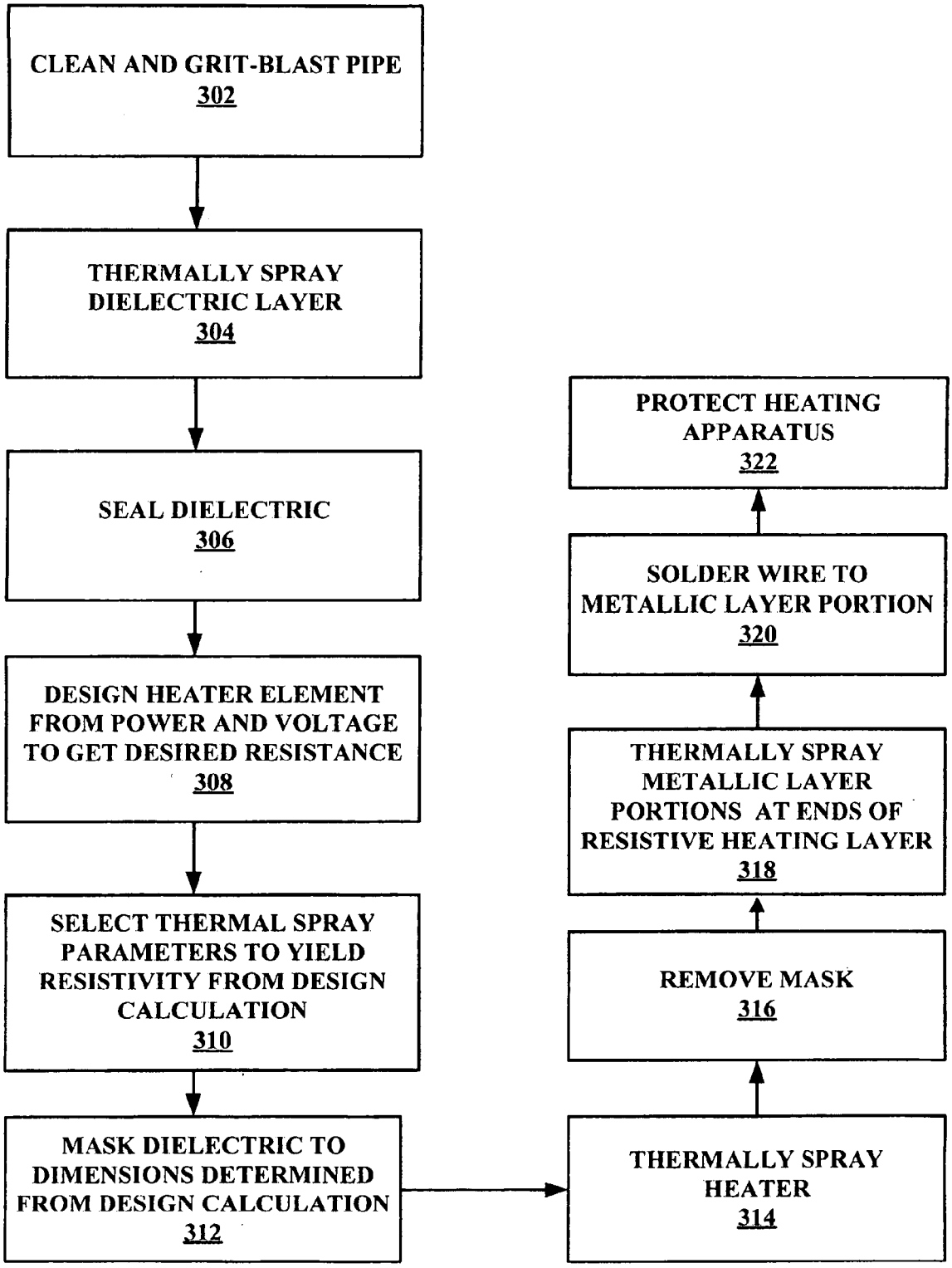
FIG. 2 is a flow chart illustrating a method of providing the heating apparatus of FIG. 1.

FIG. 2 is a flow chart 300 illustrating a method of providing the abovementioned heating apparatus 200, in accordance with a first exemplary embodiment of the invention. It should be noted that any process descriptions or blocks in flow charts should be understood as representing steps that include one or more instructions for implementing specific functions in the process, and alternate implementations are included within the scope of the present invention in which functions or steps may be executed out of order from that shown or discussed, including substantially concurrently or in reverse order, depending on the functionality involved, as would be understood by those reasonably skilled in the art of the present invention.

As is shown by block 302, a metallic pipe (the core 202 (FIG. 1)) is cleaned. It should be noted that the core 202 (FIG. 1) might also be grit blasted during or after cleaning so as to provide a gritty finish to the exterior surface of the metallic pipe. Of course, other methods of providing a gritty finish may be used. In addition, the pipe need not be entirely metallic, as long as is contains conductive properties necessary for conducting heat as is necessary for the heating apparatus 200.

The dielectric layer 204 (FIG. 1) is then thermally sprayed (block 304) onto the exterior surface of the core 202 (FIG. 1). As mentioned above, the dielectric layer 204 (FIG. 1) is an electrical insulator that is thermally conductive. Examples of materials that may be utilized as the dielectric layer 204 (FIG. 1) include, but are not limited to, aluminum oxide, porcelain, zirconium oxide, spinel, other ceramics, and polymers.

The dielectric layer 204 is then sealed by the dielectric sealant (block 306). Examples of sealants may include a polymer sealant such as, but not limited to, polyketone, or other polymers, glassy materials, and/or nanophase materials. As mentioned above, since the thermally sprayed dielectric layer 204 (FIG. 1) is partially porous, the sealant penetrates open porosity and seals the dielectric layer 204 (FIG. 1), thereby improving strength of the dielectric layer 204 (FIG. 1) in accommodating for large amounts of voltage provided to the heating apparatus.

The resistive heater layer 206 (FIG. 1) is then designed from a specific power (P) and voltage (V), to obtain a desired resistance (R) (i.e., $R=V^2/P$) (block 308). In addition, suitable resistivity (r), length (L), width (w), and thickness (t) are determined (i.e., $R-(rL)/(wt)$). Thermal spraying parameters are then selected to yield a resistivity from the above calculations (block 310).

As is shown by block 312, the sealant on the dielectric layer 204 (FIG. 1) is then masked to the above-calculated dimensions so as to allow the resulting resistive heater layer 206 (FIG. 1) to have the predetermined length, width, and thickness (explained further below). This may also be considered as masking the dielectric layer 204 (FIG. 1).

The resistive heater layer 206 (FIG. 1) is then thermally sprayed on the sealant (block 314), where the length, width, and thickness of the resistive heater layer 206 (FIG. 1) have been predetermined in accordance with the specific power and voltage to be administered to the heating apparatus 200 (FIG. 1). It should be noted that the procedure of designing the resistive heater layer 206 (FIG. 1) to have a specific thermal resistivity, and the process of thermally spraying the resistive heater layer 206 (FIG. 1), are described in detail in the '183 patent.

The mask is then removed from the sealant (block 316) on the dielectric layer 204 (FIG. 1) after thermally spraying the resistive heater layer 206 (FIG. 1), thereby resulting in the resistive heater layer 206 (FIG. 1) having the desired resistivity, length, width, and thickness. It will be understood by those having ordinary skill in the art, that many different methods of masking may be used, such as, but not limited to, using masking tape or a spring.

The metallic layer portion 212 (FIG. 1) is thermally sprayed at ends of the resistive heater layer 206 (block 318). The metallic layer portion 212 (FIG. 1) may be made of copper or any other conductive material. As an example, the metallic layer portion 212 (FIG. 1) may instead comprise nickel, gold, silver, or other metals. It should be noted that the material utilized for the metallic layer portion 212 (FIG. 1) should be capable of adhering to the material used to create the resistive heater layer 206 (FIG. 1) and be capable of having solder adhere thereto.

The electrical wire 216 (FIG. 1) is then soldered to the metallic layer portion 212 (FIG. 1) (block 320). The heating apparatus is then protected (block 322). To complete the heating apparatus 200 (FIG. 1) the electrical contact area 210 (FIG. 1) may be protected by a material. As an example, the electrical contact area 210 (FIG. 1), or ends of the heating apparatus 200 (FIG. 1), may have an epoxy tape wrapped around it. The heating apparatus 200 (FIG. 1) may then have a heat-shrink sheath wrapped around the heating apparatus 200 (FIG. 1), and the epoxy may be cured.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A method for providing a heating apparatus, comprising the steps of:

providing a conductive core;

thermally spraying a dielectric layer onto an exterior surface of said core;

selecting thermal spraying parameters for a resistive heater layer to yield a desired resistivity;

thermally spraying said resistive heater layer on said dielectric layer, wherein said resistive heater layer yields said desired resistivity; and providing a conductive layer portion on at least one end of said resistive heater layer, wherein said step of selecting thermal spraying parameters for said resistive heater layer further comprises the steps of:

selecting a metallic component and at least on reactant gas; and selecting a proportion of said metallic component and said at least one reactant gas, so that when combined said desired resistivity of said resistive heater layer results.

2. The method of claim 1, wherein said conductive core is metallic.

3. The method of claim 1, further comprising the step of providing a sealant on said dielectric layer.

4. The method of claim 1, wherein the step of thermally spraying said resistive heater layer on said dielectric layer further comprises the step of promoting reaction of said metallic component and said reactant gas, herby combining said metallic component and said reactant gas, resulting in a free metal and a reaction product.

5. The method of claim 1, further comprising the step of designing said resistive heater layer from a specific power and voltage to obtain a desired resistance.

6. The method of claim 5, further comprising the step of determining a length width, and thickness of said resistive heater layer.

7. The method of claim 1, further comprising the steps of:

providing a mask on said dielectric layer in accordance with said determined length, width, and thickness of said resistive heater layer, prior to said step of thermally spraying said resistive layer on said dielectric layer; and removing said mask, after said step of thermally spraying said resistive heater layer on said dielectric layer.

8. The method of claim 1, wherein said conductive layer portion is provided on a first end and a second end of said resistive heater layer.

9. A method for providing a heating apparatus, comprising the steps of:

providing a conductive core;

thermally spraying a dielectric layer onto an exterior surface of said core;

selecting thermal spraying parameters for a resistive heater layer to yield a desired resistivity; and thermally spraying said resistive heater layer on said dielectric layer, wherein said resistive heater layer yields said desired resistivity, wherein said step of selecting thermal spraying parameters for said resistive heater layer further comprises the steps of:

selecting a metallic component and at least on reactant gas; and selecting a proportion of said metallic component and said at least one reactant gas, so that when combined said desired resistivity of said resistive heater layer results.

* * * * *